US006753479B2

(12) United States Patent
Sugimaru et al.

(10) Patent No.: US 6,753,479 B2
(45) Date of Patent: Jun. 22, 2004

(54) PLATED METAL WIRE AND METHOD AND APPARATUS FOR PRODUCING THE SAME

(75) Inventors: Satoshi Sugimaru, Kimitsu (JP); Seiki Nishida, Kimitsu (JP); Satoru Tanaka, Kimitsu (JP); Akira Takahashi, Kimitsu (JP); Atsuhiko Yoshie, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/239,067

(22) PCT Filed: Mar. 16, 2001

(86) PCT No.: PCT/JP01/02134

§ 371 (c)(1),
(2), (4) Date: Sep. 17, 2002

(87) PCT Pub. No.: WO01/68932

PCT Pub. Date: Sep. 20, 2001

(65) Prior Publication Data

US 2003/0034170 A1 Feb. 20, 2003

(30) Foreign Application Priority Data

Mar. 17, 2000 (JP) ..... 2000-076470
Mar. 31, 2000 (JP) ..... 2000-099358

(51) Int. Cl.[7] ..... H01B 5/00
(52) U.S. Cl. ..... 174/126.1; 174/129 R; 29/868
(58) Field of Search ..... 174/126.2, 128.1, 174/129 R, 133 R; 29/868

(56) References Cited

U.S. PATENT DOCUMENTS

| | | | | |
|---|---|---|---|---|
| 592,703 | A | * 10/1897 | Gray | 174/126.2 |
| 2,060,859 | A | * 11/1936 | Flynt | 52/84 |
| 2,417,785 | A | * 3/1947 | Slepian | 333/236 |
| 4,579,317 | A | * 4/1986 | Foissner et al. | 256/10 |
| 5,696,352 | A | * 12/1997 | Kourimsky | 174/126.3 |
| 5,808,238 | A | * 9/1998 | Munakata et al. | 174/42 |

FOREIGN PATENT DOCUMENTS

| | | |
|---|---|---|
| JP | 5-51715 | 3/1993 |
| JP | 6-3086 | 1/1994 |
| JP | 2000-129417 | 5/2000 |

* cited by examiner

*Primary Examiner*—Chau N. Nguyen
(74) *Attorney, Agent, or Firm*—Kenyon & Kenyon

(57) ABSTRACT

This invention provides a plated metal wire excellent in corrosion resistance and resistance to the cracking and peeling of a plated layer and/or a plated alloy layer during working, subjected to hot dip zinc alloy plating and used for outdoor and exposed structures such as wire mesh for construction, net cages for revetments, fishing nets, outdoor fences, etc., a method for producing the plated metal wire, and an apparatus for carrying out the method.

The present invention relates to a plated metal wire characterized in that; the region where at least 3 projections, each 3 μm or more in height, per 1 mm along its circumference exist occupies 10% or more of the circumference, and the circumference having the projections thus distributed occupies 10% or more of any given portion along the length of the metal wire; and a method and an apparatus for producing the plated metal wire.

8 Claims, 1 Drawing Sheet

PLATED METAL WIRE AND METHOD AND APPARATUS FOR PRODUCING THE SAME

TECHNICAL FIELD

This invention relates to a plated metal wire having enhanced corrosion resistance required of metal materials for outdoor and exposed uses such as construction, revetments, fishing nets, fences, etc., and a method and an apparatus to produce the plated metal wire. The plated metal wires include: plated steel wires such as steel wires for wire mesh, bridge cables, PWS wires, PC wires, ropes and the like; plated steel wires for machine components such as screws, bolts, springs and the like; and other steel products.

BACKGROUND ART

Among plated metal wires, and among plated steel wires in particular, galvanized steel wires and zinc-aluminum alloy plated steel wires, which are superior to the galvanized steel wires in corrosion resistance, are commonly used. The zinc-aluminum alloy plated steel wires are produced, generally, by subjecting a steel wire to the following sequential processes: washing, degreasing, or other means of cleaning; flux treatment; plating either by a two-step plating process composed of a first step of hot dip plating in a plating bath mainly containing zinc and a second step of hot dip plating in a Zn—Al alloy bath containing 10% of Al or by a one-step plating process in a Zn—Al alloy bath containing 10% of Al; then, after vertically extracting the wires from the plating bath, cooling; and winding into coils.

Although the zinc-aluminum alloy plated steel wire has a good corrosion resistance, the wire surface is made smooth by the action of the surface tension during the wire extraction. Therefore, when the wire is formed into a structure such as wire mesh, a fastening wire, etc., the structure does not have a sufficiently roughened surface or a irregular surface. For this reason, there is a problem that the structure slips easily when laid on the ground.

Another problem is that, when the plated steel wire is further coated with resin, for example, the adhesion of resin is poor owing to the smooth surface.

To cope with these problems, methods were studied to make the wire surface rougher. An example of such an attempt is a technique applied to galvanized steel sheets used for scaffolds for building construction work, molding forms for concrete casting work and the like proposed in Japanese Unexamined Patent Publication No. H9-78216, wherein a plated surface is roughened after hot dip galvanizing by blowing water droplets 20 to 300 $\mu$m in size at a water density of 50 to 750 cc/m$^2$. An evenly distributed surface roughness is formed by this method, but the method is meant for steel sheets, and there is a problem that it is inapplicable to a steel wire because, when applied to a steel wire without modification, an even distribution of the roughness in the circumference direction is not secured. Another problem with the method is that the roughened surface are small owing to the small amount of water and a sufficient friction is not obtained.

DISCLOSURE OF THE INVENTION

In view of the above problems, the object of the present invention is to provide a plated metal wire with high friction for outdoor and exposed uses, such as gauze for constructions, net cages for revetments, fishing nets, outdoor fences, etc., and a method and an apparatus to produce the plated metal wire.

The gist of the present invention, which solves the above problems, is as follows:

(1) A plated metal wire characterized in that; the region where at least 3 projections, each 3 $\mu$m or more in height, per 1 mm along its circumference exist occupies 10% or more of the circumference, and the circumference having the projections thus distributed occupies 10% or more of any given portion along the length of the metal wire.

(2) A plated metal wire characterized in that the region where the surface roughness (Ra) of the plated metal wire is 2.5 $\mu$m or more occupies 10% or more of its circumference and 10% or more of any given portion along the length of the metal wire.

(3) A plated metal wire according to the item (1) or (2), characterized in that the plating is hot dip plating of aluminum, aluminum alloy, tin, tin alloy, zinc or zinc alloy.

(4) A plated metal wire according to the item (1) or (2), characterized in that the plating is electroplating of nickel, copper, copper alloy, aluminum, aluminum alloy, zinc or zinc alloy.

(5) A plated metal wire according to any one of the items (1) to (4), characterized in that the core metal wire consists of a steel containing, in mass, 0.02 to 1.15% of C, 1% or less of Si and 1% or less of Mn (6) A plated metal wire according to the item (5), characterized in that the core metal wire consists of a steel containing, in mass, 0.02 to 0.25% of C, 1% or less of Si and 0.6% or less of Mn.

(7) A method to produce a plated metal wire characterized in that, on the plated surface, the region where at least 3 projections, each 3 $\mu$m or more in height, per 1 mm along its circumference exist occupies 10% or more of a circumference, and the circumference having the projections thus distributed occupies 10% or more of any given portion along the length of the metal wire, as a result of applying hot dip plating of aluminum, aluminum alloy, tin, tin alloy, zinc or zinc alloy to the core metal wire consisting of a steel wire containing, in mass, 0.02 to 1.15% of C, 1% or less of Si and 1% or less of Mn and then cooling the plated metal wire by blowing an atomized cooling medium.

(8) A method to produce a plated metal wire according to the item (7), characterized in that, on the plated surface, the region where the surface roughness (Ra) of the plated metal wire is 2.5 $\mu$m or more occupies 10% or more of its circumference and 10% or more of any given portion along the length of the metal wire.

(9) An apparatus to produce a plated metal wire by immersing a metal wire or a pre-plated metal wire in a hot dip plating pot, characterized by having:

- a purging device to prevent a plating bath surface and the plated metal wire surface from oxidizing, installed at the position where the metal wire is extracted from the hot dip plating pot;
- a temperature controller to control the surface temperature of the plated metal wire to a prescribed temperature; and
- a cooler to blow a cooling medium onto the surface of the plated metal wire controlled to the prescribed temperature for the purpose of forming roughness on its surface.

(10) An apparatus to produce a plated metal wire according to the item (9), characterized in that two or more nozzles to blow the cooling medium are arranged in the cooler at equal intervals in the circumferencial direction of the metal wire.

(11) An apparatus to produce a plated metal wire according to the item (9), characterized in that the distance between each of the nozzles to blow the cooling medium in the cooler and the plated metal wire is 10 to 500 mm.

BEST MODE FOR CARRYING OUT THE INVENTION

Figure 1:
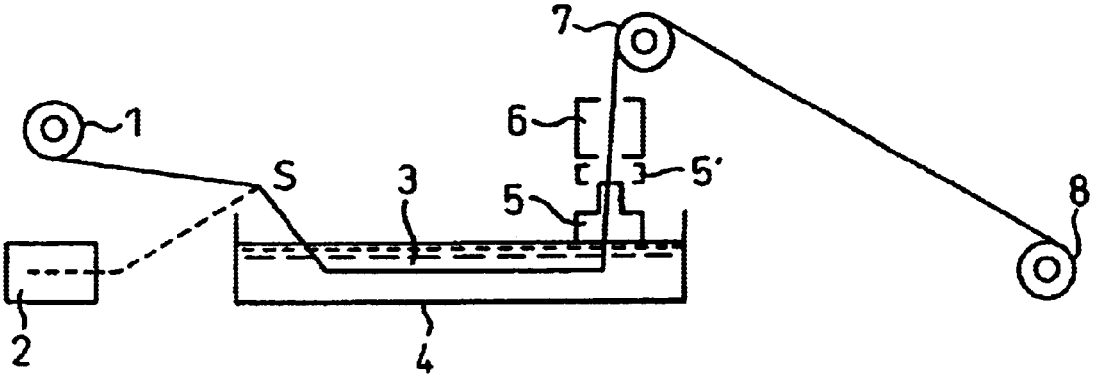
FIG. 1 is a schematic view showing an outline of a plating apparatus used for producing a plated metal wire according to the present invention.
Figure 2:
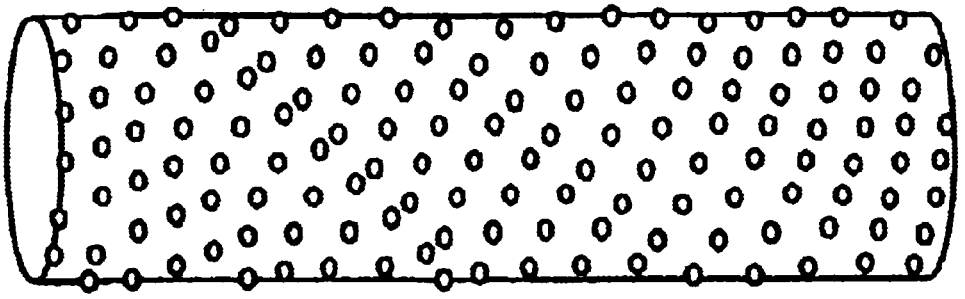
FIG. 2 is a schematic view illustrating an example of the distributed projections on the circumference of the plated metal wire in accordance with the present invention.

The embodiments of the present invention will be explained hereafter.

The surface of a conventional plated steel wire, as an example of a plated metal wire, is kept smooth to enhance its commercial value. A plated steel wire having such a smooth surface can be used for general applications but not for outdoor and exposed uses such as building components, materials for revetments, fishing nets, fences, etc. where slippage resistance is required, as described before.

The present inventors discovered that a wire surface region having at least 3 projections, each 3 μm or more in height, per 1 mm along its circumference was effective for creating slippage resistance. Each of the projections has to be 3 μm or more in height since projections less than 3 μm in height do not bring about a sufficient anti-slipping effect. The larger the projection height, the larger the anti-slipping effect, and thus a preferable projection height is 6 μm or more and, yet more preferably, 9 μm or more. The anti-slipping effect appears when at least 3 projections per 1 mm along a wire circumference are present. If the number of the projections per 1 mm along the wire circumference is less than 3, no anti-slipping effect is obtained. The larger the number of projections, the larger the anti-slipping effect. Thus a preferable number of the projections per 1 mm along the wire circumference is 5 or more and, yet more preferably, 10 or more.

On the basis of the above finding, the present inventors studied an optimum surface roughness for providing a plated metal wire with slippage resistance. It was first discovered that, when a region having a surface roughness (Ra) of 2.5 μm or more existed on the surface of the plating, abrasion resistance increased and an anti-slipping effect was obtained. A good anti-slipping effect is not obtained with an Ra below 2.5 μm. The larger the surface roughness, the better the anti-slipping effect. A preferable Ra value is 5 μm or more and, yet more preferably, 7 μm or more.

It was also made clear that, even in the case that a range having the above surface roughness did not cover the entire plating surface, such as the case that the range exists in spots or in a spiral pattern, a sufficient anti-slipping effect was obtained by securing a certain area percentage or more of the roughened surface. It is not easy to measure an area percentage on the surface of a plated steel wire, which has a round section. In the present invention, however, an anti-slipping effect is obtained when the roughened surface area covers 10% or more of a circumference and 10% or more of the length in any given portion of a certain length. If either of the percentages is below 10%, no anti-slipping effect is obtained, and thus the lower limit is set at 10%. The larger the percentage, the better the effect. A preferable percentage is 20% or more and, yet more preferably, 50% or more.

An easy and reliable method to obtain the plated surface roughness is, in the case of an electrolytic plating method, to make a plating metal deposit unevenly on the metal wire surface, and, in the case of a hot dip plating method, to blow a cooling medium in a mist onto the surface of a plated metal wire using two or more nozzles during the course of solidification of the plated metal. When one nozzle is used and the cooling medium is blown to the wire from one direction, the surface roughness is formed on one side of the plated wire but, since the wire twists during its production and working, the surface roughness is formed in a spiral pattern. When more number of nozzles are used and the cooling medium is blown from two or more directions, all the wire surface becomes rough and its distribution becomes more stable.

The present invention is applicable to the plating of a metal wire including a steel wire, a copper wire, a tungsten wire and other metal wires. A typical chemical composition of a steel wire used for the purpose of the present invention is, in mass, 0.02 to 1.15% of C, 1% or less of Si and 1% or less of Mn, i.e. a chemical composition of a commonly used steel wire. A steel containing, in mass, 0.02 to 0.25% of C, 1% or less of Si and 0.6% or less of Mn is used especially for a metal wire for forming nets.

Corrosion resistance of a hot dip galvanized steel wire or a hot dip zinc alloy plated steel wire obtained according to the present invention may be further enhanced by coating one or more of the high molecular compounds selected from among vinyl chloride, polyethylene, polyurethane and fluororesin. In this case, adhesion is enhanced by an anchoring effect caused by the high molecular compounds firmly penetrating the rough surface and the plated steel wire has the effect of being durable to the drawing in the longitudinal direction of the steel wire.

Since a plated steel wire according to the present invention can avoid luster thanks to an appropriate surface unevenness, it is excellent in anti-glare property. For this reason, the steel wire has an advantage that, when applied to fences and the like, it easily matches well with surroundings without painting owing to the absence of a metallic luster. Another advantage of the surface unevenness is that, when a plated steel wire or a fabricated material thereof is to be painted, paint adhesion is better compared with a conventional plated steel wire having a smooth surface. Further, when a plated steel wire according to the present invention undergoes a working, lubricant fills the concavities of the surface unevenness and the movement of the plated steel wire in the tool is made smooth. Thus, its feeding behavior during working is improved.

Any commonly used plating metal shows similar effects when used for the present invention. The plating of zinc alloys such as the Zn—Al alloy described in Japanese Patent No. 2732398, the Zn—Al—Mg alloy described in the Specification of Japanese Patent Application No. H11-302685 and the like shows excellent corrosion resistance and are suitable for the purpose of the present invention.

It is preferable to use a plating apparatus described hereafter for producing a plated metal wire according to the present invention.

FIG. 1 is a schematic view showing an outline configuration of an apparatus to produce a hot dip galvanized steel wire according to the present invention. In the figure, a steel wire s to be plated is a steel wire cold drawn to a diameter of 4 to 6 mm, on-line or off-line, after hot rolling. It is uncoiled and paid off from a pay-off reel 1 and fed to a plating pot 4. Another steel wire S to be plated is subjected to pre-plating such as pure zinc plating, Zn—Al alloy plating, a flux treatment, etc. and pre-treated to form an alloy layer on the steel wire surface. The steel wire S is fed from the pay-off reel 1 to an apparatus 2 for the pre-treatment and then to a hot dip galvanizing pot 4 housing a plating bath 3 in a single strand or plural parallel strands for hot dip galvanizing. The range of the travelling speed of the steel wire in the plating bath is from 10 to 100 m/min., approximately. It is usually about 50 m/min. in commercial operation.

The steel wire S plated in the plating bath passes through a box-shaped purging apparatus 5 installed so as to cover the plated steel wire at the exit of the plating bath.

The purging apparatus 5 is provided for the purpose of preventing the plating alloy bath surface and the plated steel wire from oxidizing by means of purging the exit portion of the plating bath with nitrogen gas, argon gas or carbon dioxide gas or a mixture of two or three of them. In the purging apparatus 5, the gas supplied from a gas generator (not shown in the figure) at a certain pressure is blown onto the surface of the plated steel wire. It is preferable that the purging apparatus 5 is installed in a manner that its lower end is immersed in the plating bath.

As the plated steel wire 5 passes through the purging apparatus 5, the surface temperature of the plated steel wire S is controlled by a temperature controller 5'. The function of the temperature controller 5' may be incorporated in the purging cylinder in a manner that the plated steel wire is cooled with the gas. The wire surface temperature may be controlled, for example, by blowing a cooling medium controlled to form an even flow at a low pressure. More specifically, a method to blow the cooling medium formed in a thin film onto the plated wire is effective. Since the plated metal is in a liquid state at the time of the cooling, it is important to carry out the temperature control without causing the plated metal to deform. Controlling the surface temperature to a temperature of approximately 20° C., preferably 10° C. or less, above the melting point of the plating alloy enables the formation of the surface roughness at a cooler in the succeeding stage.

Then, the steel wire is fed to a cooler 6, where the plated metal is solidified and, at the same time, the surface roughness is formed. The most important feature of the present invention is that the cooler 6 has a function to form the roughness on the curved surface of the plated steel wire beside the function to cool it. Namely, a cooler is provided for continuously cooling the plated alloy with a cooling medium in the state of mist water, an aqueous solution of an oil or a chemical or a liquid containing suspended particles may be used as the cooling medium for the present invention. Water is often used for economical reasons. Some chemicals may be added to water to increase the thermal conductivity. Also, small particles may be suspended in the liquid so as to act as nuclei for forming droplets.

The cooling medium will be described hereafter using water as a typical example. The reason why the present invention stipulates that the cooling medium is sprayed in a mist is that it is necessary for obtaining a good surface roughness to hit the surface of the unsolidified plated metal with water droplets but, if the droplets are too large, water will flow in rivulets to wash away the plated metal or blow it away It is preferable to provide two or more nozzles to blow the cooling medium at equal intervals around the metal wire to obtain an even plating thickness distribution in the circumference direction of the wire. The larger the number of nozzles, the more preferable for the homogeneity of the plated layer, but 3 or 4 nozzles are appropriate for the cost reasons. Since the back pressure of nozzles is 1,000 to 100,000 Pa (0.1 to 10 kgf/cm$^2$G) usually, if the distance between a nozzle and a metal wire surface is below 10 mm, the plated layer is blown away and, if it exceeds 500 mm, a desired surface roughness is not formed. For this reason, it is preferable that the distance is 10 to 500 mm.

Further, the reason why the surface temperature of a plated steel wire is controlled before the blowing of atomized water is that, if the temperature is higher than the melting point of the plated alloy, the alloy stays in a complete liquid state without solidifying and is blown away by the mist. For this reason, it is preferable that the temperature of the plated alloy is controlled to 20° C. or less above its melting point and, yet more preferably, 10° C. or less above the same.

By using the cooling means described above, unevenness is created on the circumferential surface of a plated steel wire, with projections formed by the difference between super-cooled spots and normally cooled spots. The surface roughness (Ra) of the plated wire provided with the unevenness described above is 3 $\mu$m at the maximum in its entire length, and the uneven surface portions contribute to abrasion resistance. The plated steel wire having slippage resistance can thus be produced continuously. The plated steel wire cooled as described above is deflected by a turning means such as a bridle roll 7 and is wound into a product coil by a reel

EXAMPLE

JIS G 3505 SWRM6 steel wires 4 mm in diameter were plated with pure zinc and given different surface unevennesses, and their anti-slipping property and surface roughness were evaluated. The anti-slipping property was measured in terms of the friction coefficient against a rubber block and the sample showing a friction coefficient value of 0.7 or more was evaluated as good (marked with ○ in the table, otherwise marked with x). The surface roughness (Ra) in the circumference direction was measured with a surface roughness meter. The example steel wires of numbers 1 to 4 were those produced according to the present invention. Comparative sample steel wires of numbers 5 and 7 had too small a roughened region in the circumference direction, and they showed low friction coefficient values. The comparative sample steel wire number 6 had too small a roughened region in the longitudinal direction, and a desired surface roughness was not obtained. In the measurement of the unevenness on the steel wire surface, the unevenness on the plated steel wire surface was measured with a surface roughness meter, and the region where 3 or more projections 3 $\mu$m or more in height per 1 mm along a circumference were present was counted. The surface roughness (Ra) was measured in accordance with the method stipulated in JIS B 0601.

TABLE 1

| | Region with 3 or more projections 3 $\mu$m or more in height per 1 mm along circumference | | Region with Ra of 2.5 $\mu$m or more | | | |
|---|---|---|---|---|---|---|
| Sample No. | Along circumference | Along length | Along circumference | Along length | Friction coefficient | Evaluation |
| 1 | 13% | 17% | 18% | 21% | 0.71 | 0 |
| 2 | 11% | 22% | 12% | 19% | 0.72 | 0 |
| 3 | 55% | 21% | 48% | 35% | 0.75 | 0 |
| 4 | 61% | 83% | 68% | 76% | 0.79 | 0 |
| 5 | 8% | 32% | 7% | 25% | 0.58 | x |
| 6 | 100% | 5% | 98% | 8% | 0.63 | x |
| 7 | 6% | 21% | 9% | 16% | 0.54 | x |

Industrial Applicability

As described above, the present invention provides a hot dip zinc alloy plated metal wire having slippage resistance for outdoor and exposed uses, such as wire mesh for constructions, net cages for revetments, fishing nets, outdoor fences, etc., and a method and an apparatus to produce the plated metal wire.

What is claimed is:

1. A method to produce a plated metal wire characterized in that, on the plated surface, the region where at least 3 projections, each 3 μm or more in height, per 1 mm along its circumference exist occupies 10% or more of a circumference, and the circumference having the projections thus distributed occupies 10% or more of any given portion along the length of the metal wire, as a result of applying hot dip plating of aluminum, aluminum alloy, tin, tin alloy, zinc or zinc alloy to the core metal wire consisting of a steel wire containing, in mass, 0.02 to 1.15% of C, 1% or less of Si and 1% or less of Mn and then cooling the plated metal wire by blowing an atomized cooling medium.

2. A method to produce a plated metal wire according to claim 1, characterized in that, on the plated surface, the region where the surface roughness (Ra) of the plated metal wire is 2.5 μm or more occupies 10% or more of its circumference and 10% or more of any given portion along the length of the metal wire.

3. An apparatus to produce a metal wire by immersing a metal wire or a pre-plated metal wire in a hot dip plating pot, characterized by having:

a purging device to prevent a plating bath surface and the plated metal wire surface from oxidizing, installed at the position where the metal wire is extracted from the hot dip plating pot;

a temperature controller to control the surface temperature of the plated metal wire to a prescribed temperature; and a cooler to blow a cooling medium onto the surface of the plated metal wire controlled to the prescribed temperature for the purpose of forming roughness on its surface.

4. An apparatus to produce a plated metal wire according to claim 3, characterized in that two or more nozzles to blow the cooling medium are arranged in the cooler at equal intervals in the circumferential direction of the metal wire.

5. An apparatus to produce a plated metal wire according to claim 3, characterized in that the distance between each of the nozzles to blow the cooling medium in the cooler and the plated metal wire is 10 to 500 mm.

6. A plated metal wire characterized in that the plated metal wire comprises, a steel core containing, in mass %, 0.02 to 1.15% of C, 1% or less of Si, 1% or less of Mn and the balance being Fe and unavoidable impurities, and a plated layer comprising a hot dip plating of Al, Al alloy, Sn, Sn alloy, Zn or Zn alloy, or an electroplating of Ni, Cu, Cu alloy, Al, Al alloy, Zn or Zn alloy, a region where at least 3 projections, each 3 μm or more in height, per 1 mm along its circumference exist occupies 10% or more of the circumference, and the circumference having the projections thus distributed occupies 10% or more of any given portion along the length of the metal wire.

7. A plated metal wire according to claim 6, wherein the region where the surface roughness (Ra) of the plated metal wire is 2.5 μm or more occupies 10% or more of its circumference and 10% or more of any given portion along the length of the metal wire.

8. A plated metal wire according to claim 6, wherein the steel core contains, in mass %, 0.02 to 0.25% of C, 1% or less of Si, 0.6% or less of Mn and the balance being Fe and unavoidable impurities.

* * * * *